US005678825A

United States Patent [19]

Clayton

[11] Patent Number: 5,678,825

[45] Date of Patent: *Oct. 21, 1997

[54] FLUID PROJECTING TOY

[76] Inventor: Richard A. Clayton, 10200 Hillview Ave., Chatsworth, Calif. 91311

[ * ] Notice: The term of this patent shall not extend beyond the expiration date of Pat. No. 5,470,082.

[21] Appl. No.: 563,196

[22] Filed: Nov. 27, 1995

Related U.S. Application Data

[63] Continuation-in-part of Ser. No. 88,981, Jul. 7, 1993, Pat. No. 5,470,082.

[51] Int. Cl.[6] ..... A63F 9/00

[52] U.S. Cl. ..... 273/445

[58] Field of Search ..... 273/459, 445, 273/446, 440, 349, 395, 396, 397, 138.1; 446/475; 239/97, 98, 70, 373, 331, 251, 252, 265.11, 241

[56] References Cited

U.S. PATENT DOCUMENTS

| | | | |
|---|---|---|---|
| 132,407 | 10/1872 | Neer | 239/373 X |
| 285,055 | 9/1883 | Morrell | 239/331 X |
| 1,074,336 | 9/1913 | Wismar | 239/241 |
| 1,999,470 | 4/1935 | Munz | 239/421 X |
| 2,979,271 | 4/1961 | Boyden | 239/421 X |
| 3,594,000 | 7/1971 | Glass et al. | 273/445 X |
| 3,843,127 | 10/1974 | Lack | 273/349 |
| 4,113,259 | 9/1978 | Sands | 273/241 |
| 4,526,366 | 7/1985 | Kendon | 273/349 X |
| 4,579,340 | 4/1986 | Jenkins et al. | 273/395 X |
| 5,195,751 | 3/1993 | Senart | 273/349 |
| 5,263,714 | 11/1993 | Rudell et al. | 273/457 X |

*Primary Examiner*—Paul E. Shapiro

[57] ABSTRACT

A toy for projecting water or other fluid matter employs a generally unpredictable discharge actuating mechanism to provide a surprise discharge from a rotatable nozzle. The toy further employs a manually operable discharge stopping mechanism to allow users to strike or press on the toy to stop a discharge once it has begun. A variety of propulsion mechanisms may be employed for rotating the nozzle to allow discharge toward players in multiple directions.

31 Claims, 5 Drawing Sheets

FLUID PROJECTING TOY

BACKGROUND OF THE INVENTION

This is a continuation-in-part of application Ser. No. 08/088,981 filed Jul. 7, 1993, which will issue Nov. 28, 1995 as U.S. Pat. No. 5,470,082. The specification of said allowed patent is incorporated herein by reference. This application relates to information contained in Invention Disclosure Document No. 286259 filed Jul. 8, 1991 which was referenced by the aforementioned application.

The present invention relates to fluid projecting toys and games and more particularly to such devices having a rotatably carried nozzle and mechanisms for controlling discharge from the nozzle.

Toys and games exist in the prior art for projecting water radially outward toward players. For example, U.S. Pat. No. 3,843,127 (Lack) discloses a rotating figurine which discharges water, but has no mechanisms for starting or stopping the discharge.

U.S. Pat. No. 4,526,366 (Kenoun) discloses a toy having electronic means for actuating and preventing a discharge, but has no rotary nozzle and no user controlled means for stopping a discharge once it has begun. The actuation of discharge is entirely predicted and controlled by fixed rules in response to a set of user operated switches, and the discharge is stopped by the electronic circuitry after a fixed time interval. Additionally under the electronically controlled rules, the discharge cannot be directed at the player to last operate a switch.

U.S. Pat. No. 5,195,751 (Senart) discloses a game having a rotating nozzle and a set of rules involving playing cards. Discharge actuation is manual and the cards and rules are used for directing players to spray other players.

SUMMARY OF THE INVENTION

The present invention comprises a nozzle carried for rotation on a base whereby the direction of discharge of the nozzle is variable within a circular range about the axis of rotation. The invention further comprises mechanisms for initiating discharge of fluid from the nozzle and for stopping the discharge. The discharge actuating mechanism causes discharge to occur in a manner generally beyond the control of those playing with the device so as to surprise the players. The discharge stopping mechanism comprises a "button", "strike pad" or other similar actuator intended to be struck, pressed or otherwise manipulated by a player to stop the fluid discharge. Placement of the discharge stopping actuator in a central location on the toy provides additional play value as the players are caught between a natural urge to flee the discharge and a choice to reach toward the discharge to strike the actuator.

The invention also comprises mechanisms wherein an actuator or trigger such as a hand operated paddle, after an indeterminate number of actuations, causes pressurized fluid to be discharged toward a player who operates the trigger.

Therefore a primary objective of the present invention is the construction of a fluid projecting apparatus or toy which surprises players with a generally radial discharge of water or other fluid from a rotatory nozzle and which provides the players with a mechanism for stopping the discharge by pressing on a centrally located handle.

It is also an objective of the invention to provide such a toy which connects to a garden hose and derives driving force for rotation of the nozzle from the water supply pressure.

Another objective of the invention is to provide a similar free-standing fluid projecting toy which carries a supply of fluid and a self contained mechanism for pressurizing said fluid.

Another objective of the invention is to provide such a toy having a regulating mechanism for selectively actuating the discharge of fluid after an interval of play.

It is further among the objectives of the invention to provide a fluid projecting toy comprising a mechanism for actuating a discharge of pressurized fluid and a manual trigger therefore, wherein the number of actuations of the trigger required to initiate a discharge is generally unpredictable.

BRIEF DESCRIPTION OF THE DRAWINGS

The present invention, both as to its organization and manner of operation, together with further objects and advantages thereof, may best be understood with reference to the following description, taken in connection with the accompanying drawings in which.

DESCRIPTION OF EXEMPLARY EMBODIMENTS

Figure 1:
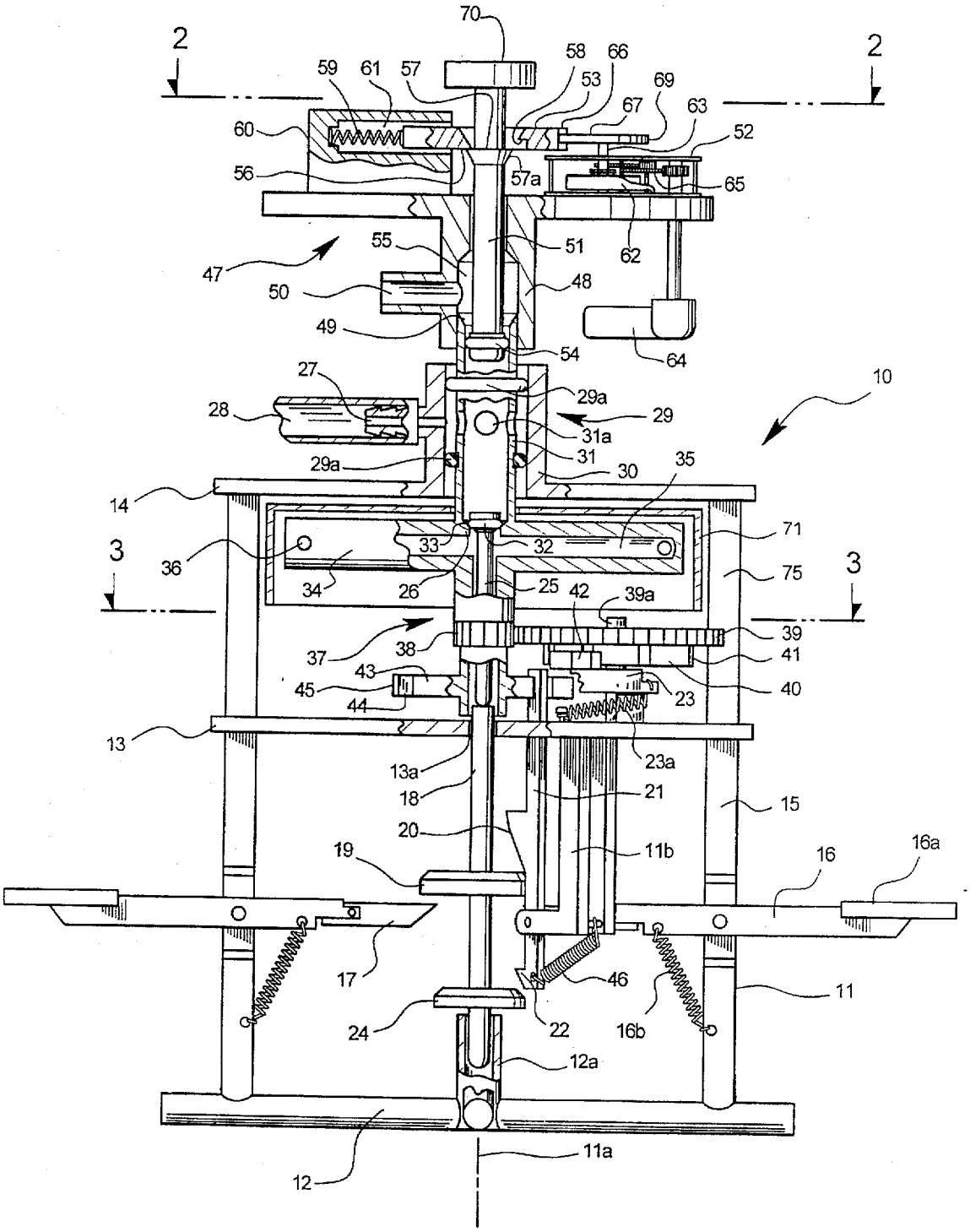
FIG. 1 is a side elevational view, partly in section, of a novel game apparatus incorporating the present invention.

Referring to FIG. 1, there is shown by way of illustration, but not of limitation, a water projecting toy designed and constructed in accordance with this invention. The toy, generally indicated in the direction of arrow 10, includes a frame 11 generally symmetrical about a vertical axis **11*a*, having a base 12, an intermediate platform 13, an upper platform 14, and four vertical members 15 equally spaced about the vertical axis 11*a*. A propulsion triggering lever 16 is pivotally supported on each of the four vertical members 15 such that the longitudinal axis of each lever 16 is radially aligned with the vertical axis of the frame 11. Each lever 16 has a pawl 17 pivotally carried on its inward end and a handle or paddle 16*a*** carried outwardly for manual actuation by players of the game.

A shaft 18, having propulsion actuation and index release functions which will be described herein, is carried on the frame 11 so as to be longitudinally coaxial with the vertical axis **11*a* and to be upwardly and downwardly movable between an upper position and a lower position along the axis 11*a*. A tube 12*a* on base 12 and a hole 13*a* in intermediate platform 13 serve as guides for shaft 18. A disk 19 is positioned on shaft 18 such that the pawl 17 of any lever 16 may engage the disk 19 during a portion of the pivotal arc of the lever 16. Pivotal motion of the lever 16 in the direction which raises pawl 17 upward away from base 12 causes pawl 17 to engage disk 19 and raise disk 19 and shaft 18 upward along the vertical axis 11***a* of the frame 11. As disk 19 is raised it engages a shoulder 20 protruding from a bar 21 which is pivotally carried on the frame 11 by supports 11*b*. The upper end of bar 21 normally engages one of four index slots 44 in a disk 43 to prevent a rotor assembly 37 from rotating with respect to the frame 11. Further upward movement of disk 19 against shoulder 20 causes bar 21 to pivot about its mount such that the upper end of bar 21 moves radially outward from the slot 44 of disk 43 and a hook 22 on the lower end of bar 21 moves radially inward toward the shaft 18. As it moves outward, the upper end of bar 21 engages a latch 23 carried on frame 11 which is oriented to prevent movement of the upper end of bar 21 back toward disk 42. Further pivotal movement of the lever 16 causes pawl 17 to disengage from disk 19, allowing shaft 18 to move downward with respect to the frame 11 until another disk 24 on shaft 18 engages hook 22 to prevent shaft 18 from returning to its lower position. Upon release of the lever 16, a spring 16*a* urges lever 16 toward its original position. Pawl 17 pivots as it contacts the upper side of disk 19 to slide past the disk and allow lever 16 to complete its return to the original position.

During the process described above, the rotor propulsion system is actuated as follows: The upper end of shaft 18 engages the plunger 25 of a valve 26 which is supplied with water through a passageway 27 from an inlet tube 28. Tube 28 in this embodiment is equipped at its other end with a connector (not shown) for mating to a common garden hose. Water from passageway 27 flows into a swivel coupling 29 having an outer housing 30, which is mounted on the upper platform 14 of frame 11, and an inner tube 31. Holes 31*a* allow water to enter tube 31. Two O-rings 29*a* form a seal between housing 30 and tube 31. The plunger 25 has a rubber O-ring 32 which normally seals the inner tube 31 at a valve seat 33. When the shaft 18 is raised upward by lever 16 it raises plunger 25 to open the valve 26 thereby allowing water to flow through a pair of arms 34, each having a passageway 35 exiting the system through an orifice 36. The orifices 36 are oriented such that water discharged through them provides rotational force to the rotor assembly 37 which comprises among other things the valve 26, arms 34, the inner tube 31 of swivel coupling 29, and disk 43. Rotational mounting of the rotor assembly 37 to the frame 11 is provided by swivel coupling 29 on the upper platform 14 and by shaft 18 at the intermediate platform 13.

Figure 3:
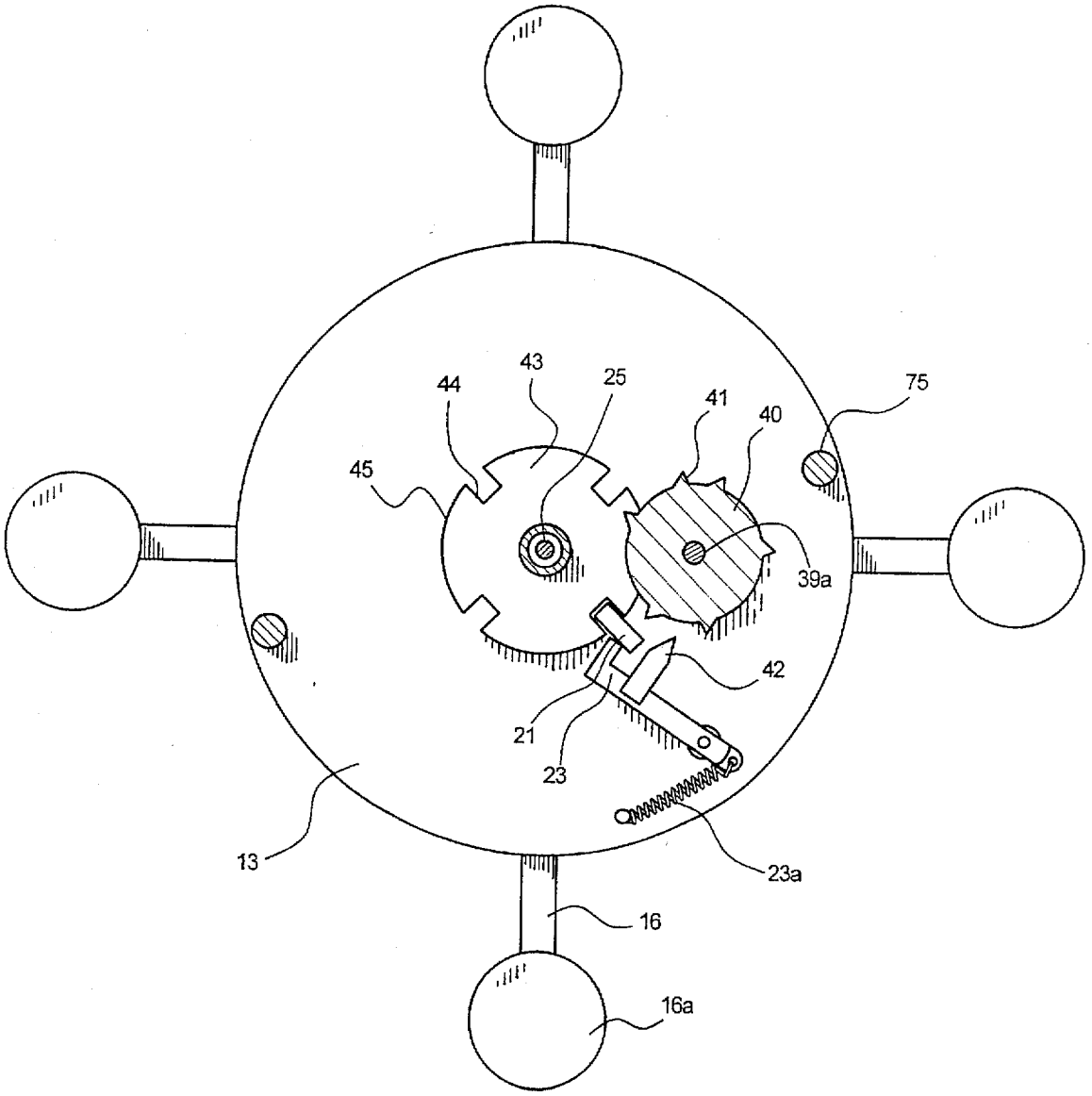
FIG. 3 is a cross-sectional view taken in the direction of arrows 3—3 of FIG. 1.

The indexing mechanism comprising bar 21 and disk 43 is designed to stop rotation of the rotor assembly 37 at ninety degree intervals, corresponding to four player positions about the toy, by virtue of the ninety degree spacing of index slots 44. An index sequencing mechanism comprising a cam assembly 40 and latch 23 causes the number of ninety degree intervals between index stops to vary, in a manner generally unpredictable to players of the game, from one actuation of rotor propulsion to another. As the rotor assembly 37 turns, a gear 38 on the rotor assembly drives another gear 39 which is rotatably carried on the intermediate platform 13 of frame 11. Gear 39 is coaxially attached to cam assembly 40 whose lobes 41 are selectively brought into contact with a shoulder 42 of latch 23 by rotation of gear 39 and cam assembly 40. Engagement of a cam lobe 41 with the shoulder 42 disengages latch 23 from bar 21. A spring 46 urges bar 21 into contact with the outer rim 45 of disk 43. The rotor assembly 37 continues to rotate until a slot 44 becomes aligned with bar 21 whereby spring 46 urges bar 21 into engagement with the slot to halt rotation. The ratio of gear 38 to gear 39 and spacing between the cam lobes 41 determine how many slots 44 will pass the position of alignment with bar 21 before bar 21 is released from latch 23. Thus, if the spacing between lobes 41 is made irregular, as in FIG. 3, the number of quarter turns of the rotor 37, for a given actuation of rotor propulsion, will be irregular and both rotor travel duration and stopping position will be generally unpredictable. When bar 21 enters a slot 44, the hook 22 on bar 21 is pivoted away from engagement with disk 24 such that shaft 18 may return to its original lower position. Water pressure in tube 31 forces plunger 25 downward to engage O-ring 32 with valve seat 33 thereby closing valve 26 to shut off the rotational force of water from arms 34.

The rotor assembly 37 additionally comprises on its upper end a spray assembly 47 having a valve 48, a valve seat 49, a nozzle 50, a plunger 51, a timer 52 and a latch 53. Water is supplied to spray assembly 47 through the inner tube 31 of swivel coupling 29. An O-ring 54 on plunger 51 normally forms a seal with valve seat 49 at the upper end of tube 31 to keep water from entering the passage 55 within valve 48. A shoulder 56 of latch 53 normally engages a disk 57 on the shaft of plunger 51 to prevent water pressure within tube 31 from forcing plunger 51 upward to open valve 48.

Timer 52 is of a spring wound mechanical type, having a spiral torsion spring 62 which biases a shaft 63 to rotate to a rest position. The timer 52 is set or activated by using handle 64 to rotate the timer mechanism including shaft 63 against the bias of spring 62. A speed regulating gear train or clock mechanism 65 controls the speed with which spring 62 drives shaft 63 back to its rest position. The further shaft 63 is rotated against the bias of spring 62, the longer timer 52 will run before shaft 63 again reaches rest position. While a spring driven clock mechanism is depicted, other drive methods may be employed. For example, toys may be constructed in accordance with this invention wherein similar clock mechanisms are driven by means such as a flywheel powered by operation of propulsion triggering levers similar to 16, a turbine or impeller powered by liquid flowing through the toy, or a gear on the rotor similar to gear 38. In all cases the clock mechanism serves to regulate the timing of discharge actuation by measuring or monitoring time, events or some other quantity, the passage of which sets an interval during which the discharge is prevented.

A finger 66 protruding from latch 53 is biased by spring 59 into engagement with a cam wheel 67 affixed to shaft 63. The cam wheel 67 has a constant radius along the majority of its perimeter and a reduced radius over a small portion in the form of a slot or notch 68. With timer 52 in its off state, which corresponds to the rest position of shaft 63 and the normal position of latch 53, finger 66 rests in slot 68. As shaft 63 and wheel 67 are rotated away from the rest position by actuation of timer 52, finger 66 is forced by cam action out of slot 68 and into engagement with the outer rim 69 of wheel 67. Latch 53 is thereby forced back within slots 61 of guides 60, against the bias of spring 59, such that shoulder 56 is disengaged from disk 57 of plunger 51. Plunger 51 is forced by water pressure upward within valve 48 until disk 57 encounters another shoulder 58 of latch 53 which restricts the plunger from further upward movement. With disk 57 and shoulder 58 thus engaged O-ring 54 remains within valve seat 49 and valve 48 remains closed.

Discharge of fluid from nozzle 50 is actuated as follows: When the timer returns shaft 63 to rest position, or times out to its off state, slot 68 is realigned with finger 66 whereby spring 59 forces latch 53 back to its normal position to disengage shoulder 58 from disk 57 such that plunger 51 is free to move upward within valve 48. If the rotor 37 is in one of its indexed positions wherein bar 21 is engaged in one of the slots 44 of disk 43, then the propulsion valve 26 will be closed allowing water pressure within tube 31 to force plunger 51 upward until O-ring 54 no longer resides within valve seat 49, thus opening valve 48 to allow water to flow through passage 55 and to exit spray assembly 47 through nozzle 50. For aesthetic purposes the spray assembly 47 may be enclosed within a hollow figurine (not shown). In such a case nozzle 50 is connected by a flexible tube or other conduit to a secondary nozzle on the figurine.

If the rotor assembly 37 is in motion between index positions when the timer releases latch 53, the propulsion valve 26 will be latched open by engagement of disk 24 and hook 22 and water pressure within tube 31 will be insufficient to open valve 48. To ensure this effect, the cross sectional area of passageway 27 is designed to be smaller than the minimum cross sectional areas found in the passageways of tube 31, valve 26, arms 34 or orifices 36, such that pressure within tube 31 can not build to a level sufficient to open valve 48 while valve 26 is open. This lack of pressure also allows the seals between O-rings 29*a* and tube 31 to relax so that tube 31 may rotate freely within housing 30. Thus the rotor will continue to rotate until the indexing mechanism stops it at a player position, at which point valve 48 will open to spray the player at that position. It is also possible to size the water passages differently or add a spring to normally bias plunger 51 upward whereby the valve 48 will open immediately as the cam 67 releases latch 53, even if the rotor is between index positions. This allows the discharge from nozzle 50 to sweep across any intervening player positions until the indexing mechanism engages to direct the remainder of the discharge at one player.

Once valve 48 is opened players may stop the discharge from nozzle 50 by pushing downward on a knob or actuator 70 on the upper end of plunger 51 to return the plunger 51 to its original lower position to re-engage O-ring 54 with valve seat 49. A beveled edge 57*a* on disk 57 allows it to slide through latch 53 as plunger 51 is reset to its lower position.

Figure 2:
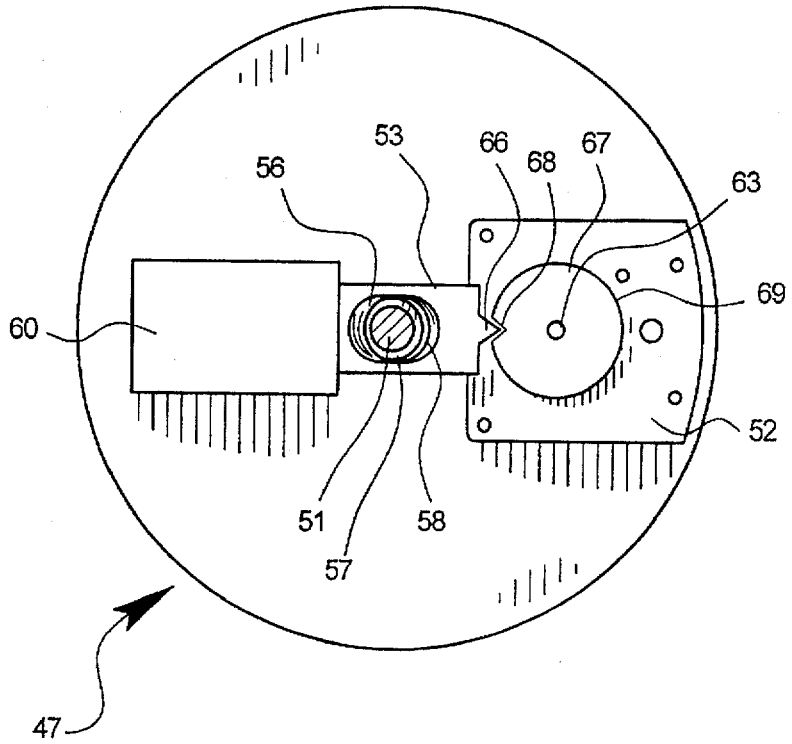
FIG. 2 is a cross-sectional view taken in the direction of arrows 2—2 of FIG. 1.

With reference to FIG. 1, FIG. 2, and the above descriptions of the timer 52 and latch 53, it is understood that the latch 53 has a three state cycle of operation, which cooperates with a device such as timer 52 having only two operating states. In this example, the timer is either in an off state or an active (set) state, and the operational states of latch 53 may be summarized as follows: A first latch state is defined when the timer 52 is in its off state and plunger 51 is restrained from upward movement by engagement of disk 57 with shoulder 56, latch 53 being forced to the right by spring 59. A second latch state is defined when the timer 52 is set and plunger 51 is restrained by engagement of disk 57 with shoulder 58, latch 53 having been forced to the left by timer wheel 67 whereby shoulder 56 is removed from the path of disk 57 and shoulder 58 is inserted in the path of disk 57. A third latch state is defined when timer 52 is in its off state and plunger 51 is free to move upward, latch 53 having been forced again to the right by spring 59 (upon expiration of timer activity) whereby shoulder 58 is taken out of the path of disk 57.

Figure 4:
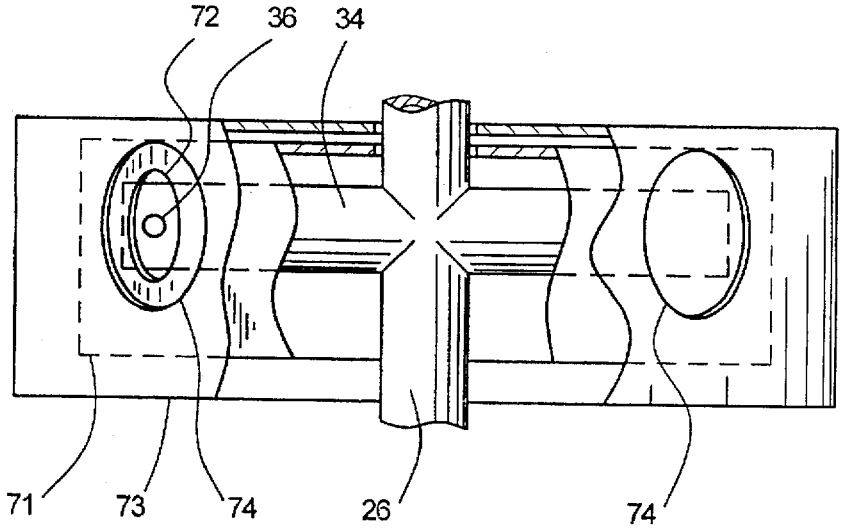
FIG. 4 is a side elevational view, partly in section, of two coaxial spray shields and a spray arm assembly employed in an embodiment of the present invention.

A cylindrical shield 71 encloses arms 34 to normally prevent the water discharged from orifices 36 from striking players. The shield may optionally be rotatably carried about the vertical axis 11*a* such that water discharged through orifices 36 rotates it in a direction counter to that of rotor assembly 37. A hole 72 in the shield 71 in the optional case (shown in FIG. 4) is positioned to periodically become aligned with an orifice 36 as the shield and rotor both rotate whereby a stream of water is occasionally discharged outward among the players to add an extra element of surprise. A stationary shield 73 may be carried on frame 11 as an additional option. In FIG. 4, the stationary shield 73 is cylindrical and encloses the rotating shield 71. Shield 73 has four holes 74 positioned in relation with the player positions whereby the occasional surprise discharge occurs only if the hole 72 in the rotating shield 71 becomes aligned with discharge from an orifice 36 as the discharge becomes aligned with a hole 74 in the stationary shield 73, such that the discharge is directed toward a player position whenever it occurs. This secondary surprise discharge adds another element of suspense to the toy in the sense that the primary discharge from spray assembly 47 is not related to actuation of the paddles 16*a*, so players are motivated to strike their paddles quickly to divert nozzle 50 from their positions. With the secondary discharge from holes 74, however, actuation of a paddle may actually cause a player to be sprayed.

The surprise discharge feature of the preceding paragraph demonstrates a principle of the present invention which may be employed as a secondary feature as described above, or which may be employed as a primary feature in a similar toy. For example, if the shields 71 and 73 as shown in FIG. 4 are incorporated into the apparatus of FIG. 1, the toy will have the previously described secondary surprise discharge feature. If the timer mechanism 52 is not actuated, the discharge from nozzle 50 will not occur and can be ignored. Then, if only one player position is utilized, i.e., if only one trigger paddle 16*a* is pressed repeatedly, the secondary surprise discharge will eventually occur in the direction of that paddle. This occurrence depends on a random simultaneous alignment of shield 71 and an orifice 36 with shield 73 during actuation of the rotor propelling jet streams from orifices 36, and thus it cannot be predicted which actuation of the paddle will lead to a discharge. What is certain is that the more times any given player actuates the system, the more likely it is that he or she will be sprayed. Thus, a toy may be constructed according to this invention wherein a trigger such as paddle 16*a* serves to actuate a mechanism which, after an indeterminate number of actuations causes pressurized fluid to be discharged toward a player who operates the trigger. This toy may be incorporated into a game where a system or device (e.g., dice, playing cards or a game "spinner") is employed to direct players to actuate the trigger a selected number of times.

The arrangement of the spray shields 71, 73 may be viewed as a discharge actuating mechanism that takes advantage of the pressurized stream from the jet propelled rotor of FIG. 1 and selectively provides a window for external discharge of the stream. It will be evident that other types of pressurizing mechanisms and discharge actuating mechanisms can be employed to construct devices of similar function. For example, a paddle such as 16*a* may be used to incrementally advance a gear train whereby a cam eventually actuates a pump or a set of tumblers eventually becomes aligned to open a valve.

Figure 5:
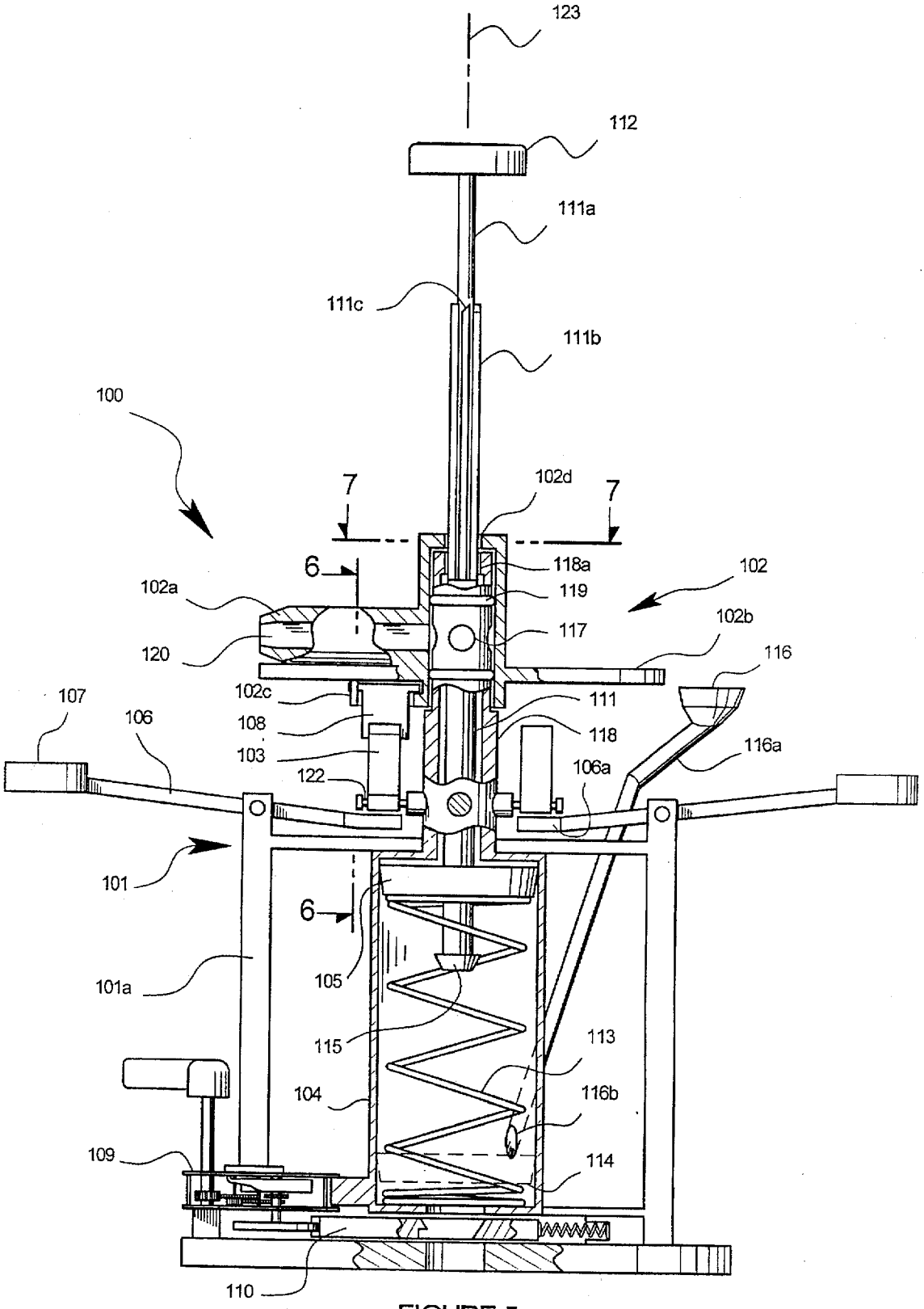
FIG. 5 is a side elevational view, partly in section, of another novel game apparatus incorporating the present invention.
Figure 6:
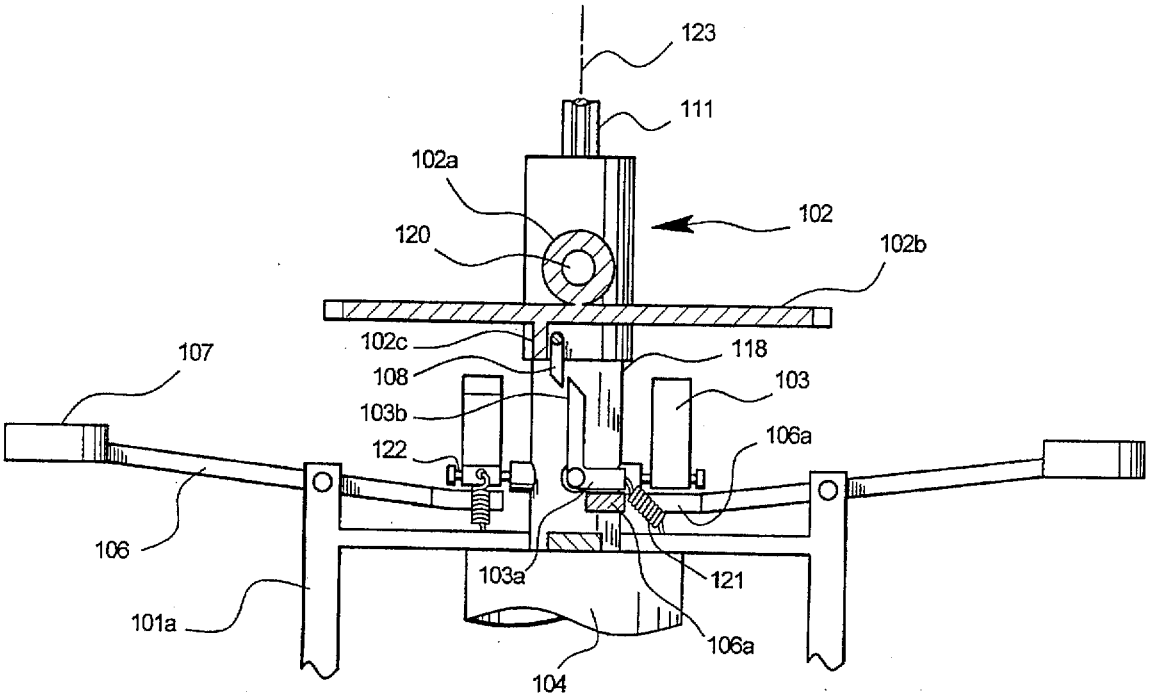
FIG. 6 is a cross-sectional view taken in the direction of arrows 6—6 of FIG. 5.

It may be desirable that the toy be independent and free of connections to a separate pressurized water supply (such as a garden hose) during operation. Such an embodiment is depicted in FIG. 5 and FIG. 6. The free-standing apparatus, generally indicated in the direction of arrow 100, comprises a frame 101 having four upright members 101*a* equally spaced about the axis of rotation 123 of a rotor assembly 102, four lever assemblies 103 pivotally carried on an upper appendage 118 of a cylinder 104 by shafts 122 in substantial alignment with upright members 101*a*, a plunger 105 within the cylinder 104, and levers 106 pivotally carried on the upright members 101*a*. Levers 106 include a striking end 106*a* for engagement with a horizontal member 103*a* of lever assemblies 103 whereby actuation of a lever 106, that is, downward displacement of the outside handle or paddle portion 107 of the lever 106, is translated to upward motion of striking end 106*a* which causes lever assembly 103 to pivot about shaft 122. A vertical member 103*b* of lever assembly 103 engages a pawl 108 hinged on a bracket 102*c* of the rotor assembly 102 such that pivotal movement of lever assembly 103 resulting from the described actuation of lever 106 is translated into rotary motion of rotor 102. Thus, in this embodiment the force delivered manually to the rotation triggering lever 106 is transferred mechanically to direct propelling force for the rotor 102, whereas in the previously described embodiment a similar lever (16 in FIG. 1) functions as a trigger for a separate jet powered propulsion mechanism (34 in FIG. 1).

An indexing mechanism (not shown in FIG. 5 for simplicity, but similar in function to the indexing mechanism of the previously described embodiment) is preferably employed to cause the rotor assembly 102 to stop rotation after an integer number of quarter revolutions such that the pawl 108 is engaged with another lever assembly 103 and so as to point a nozzle 102*a* of the rotor assembly 102 at a selected one of the player positions which correspond to the positions of the levers 106. It may be noted that since a single pawl 108 rotates as a part of rotor assembly 102, the pawl 108 may only be aligned with the triggering levers 106, 103 of one player position at a time, such that only the player position currently indexed or selected for such alignment is capable of actuating rotor propulsion.

A timer 109 having a latch 110 is mounted to the frame 101 to engage a shaft 111 of plunger 105. As previously discussed for the embodiment of FIG. 1, other metering or monitoring mechanisms may be substituted for the timer to provide an interval of play time prior to initiation of a discharge. Manual force may be applied to a handle 112 on the end of shaft 111 to force the plunger 105 downward within cylinder 104, thereby compressing a spring 113 between plunger 105 and cylinder 104. If shaft 111 and plunger 105 are forced to a lower position indicated by dashed lines and the numeral 114, a shoulder 115 on shaft 111 will engage latch 110 whereby the shaft 111 and plunger 105 are restricted from upward movement. With the plunger 105 thus positioned, the cylinder is then loaded by manually pouring water or other fluid through an inlet 116 having a conduit tube 116*a* and an opening 116*b* into cylinder 104. It is noted that cylinder 104 and plunger 105 are elements of a pump and that spring 113 biases the plunger from a charged position to a discharged position within the interior chamber of cylinder 104. Input and output check valves and a water reservoir may also be incorporated in the design whereby the pump automatically charges, i.e., draws water from the reservoir, each time the plunger 105 is moved to the lower position. The latch 110 has a three state cycle similar to the timer latch of the previously described embodiment, whereby the timer 109 may be set or activated after the apparatus has been cocked and loaded.

Play is initiated upon the setting of the timer 109. Players strike handles 107 to spin the rotor 102 to dived the nozzle 102*a* from pointing toward their positions. When the timer 109 times out, discharge is actuated as follows: Latch 110 is released as a notch on a cam wheel becomes aligned with a finger on the latch as previously described for items 68, 67 and 66 in FIGS. 1 and 2. With the latch released, spring 113 forces shaft 111 and plunger 105 upward thereby forcing water upward within cylinder 104 and out through openings 117. Clearance between shaft 111 and the opening 118*a* in the upper end of upper cylinder appendage 118 is designed to be minimal to prevent excessive leakage of water. The rotor assembly 102 is rotatably carried on the upper appendage 118 of cylinder 104, having O-rings 119 to provide a seal between rotor 102 and appendage 118 above and below openings 117 such that water forced through openings 117 must exit the system through a passage 120 and nozzle 102*a* of the rotor assembly. At any time during discharge of the pump a player may stop the discharge by pressing downward on handle 112 to override the bias of spring 113, thereby stopping or reversing the upward motion of plunger 105.

Figure 7:
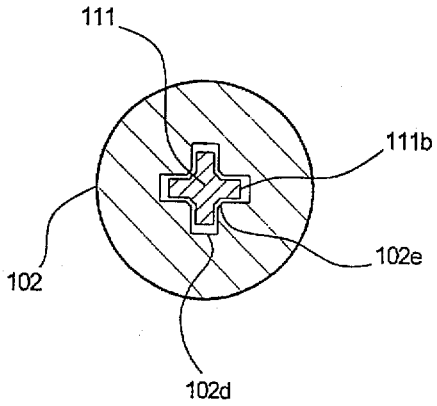
FIG. 7 is a cross-section of the apparatus of FIG. 5, taken in the direction of arrows 7—7.

A secondary indexing mechanism, best understood with reference to FIGS. 5 and 7, provides positive alignment of the nozzle 102*a* with a player position at the time of discharge. This mechanism comprises indexing slots 102*d* in the opening 102*e* in the upper end of rotor 102 through which shaft 111 protrudes. When plunger 105 is in the lower position indicated in dashed lines by the numeral 114, shaft 111 is similarly lowered, and the upper portion 111*a* of shaft 111 is positioned within opening 102*e*. Upper portion 111*a* of the shaft has a round cross-section which cannot engage the slots 102*d* so that the rotor 102 is free to rotate. When shaft 111 is released from latch 110, blades 111*b* on the lower potion of shaft 111 engage the upper end of rotor 102 to prevent further upward movement of shaft 111 and plunger 105 until rotation of the rotor 102 causes the slots 102*d* to become aligned with blades 111*b*. The blades 111*b* are provided with sloping upper surfaces 111*c* which engage similarly sloped surfaces (not shown) about opening 102*d* to assist the rotation of rotor 102 into the aforementioned alignment. The rotor support 118 is affixed to the frame 101, and the upper opening 118*a* is provided with slots (not shown) similar to the slots 102*d* in the rotor to maintain blades 111*b* in alignment with the player positions.

It is noted that a separate plunger cocking and discharge stopping actuator similar to shaft 111*a* and handle 112 may be carried by rotor 102 for rotation therewith. In such a case the actuator would also be carried for movement up and down and would be made engageable with the plunger 105 through appropriate linkages. A keyed shaft similar to 111*b* may be affixed to the plunger and adapted to slide telescopically within a similarly keyed hollow section of said actuator to provide the secondary indexing functions described in the preceding paragraph. Preferably a spring would normally bias such an actuator to the upper position regardless of the position of the plunger.

Other embodiments may be constructed employing a pump functionally similar to 104, 105 above wherein the pump is positioned in a non-central location and the rotor is provided with a discharge stopping valve having an associated manual actuator similar to handle 112 and shaft 111*a*. In such a configuration the valve may be adapted to divert flow from passage 120 to another nozzle or nozzles aimed at other player positions. Thus, if a player being sprayed acts quickly enough to depress the actuator before the pump is fully discharged, the remainder of the discharge is diverted toward other players.

Other free-standing embodiments may be constructed utilizing an on board air pump to pressurize an on board fluid reservoir. In such an embodiment a discharge actuating mechanism similar to that depicted in FIG. 1 may be employed, whereby a timer or similar device opens a valve to allow the pressurized fluid to flow to a nozzle. It may be desirable for some embodiments to employ a "press and go" type of propulsion mechanism whereby a spring is compressed by pressing a paddle similar to 107 in FIG. 5. The spring then provides power for a gear train or other transmission means which drives the rotor.

While certain embodiments of the present invention have been presented and described herein, other embodiments have been contemplated and considered. The mechanisms presented are not intended to be limiting as to the scope of this invention, and it will be obvious to those skilled in the art that changes and modifications may be made in the structures disclosed, and similar mechanisms may be constructed, without departing from the spirit of the invention defined in the following claims.

What is claimed is:

1. A fluid projecting toy comprising a frame;

a rotor assembly operably carried on said frame;

said rotor assembly comprising a nozzle for discharge of fluid therefrom;

rotation of said rotor causing the direction of discharge of said nozzle to vary with respect to said frame;

a discharge actuating mechanism carried by said frame for selectively initiating discharge of fluid from said nozzle;

said discharge actuating mechanism being at least partially automatic whereby the initiation of discharge from said nozzle is generally beyond the immediate control of those using said toy;

a discharge stopping mechanism carried by said frame;

said discharge stopping mechanism comprising an actuator adapted to stop discharge from said nozzle upon manipulation of said actuator by an operator of said toy.

2. The invention of claim 1 comprising a jet propulsion mechanism for urging said rotor to rotate.

3. The invention of claim 1 including:

said rotor carried for rotation about a generally vertical axis;

said actuator of said discharge stopping mechanism comprising a shaft generally aligned with said axis of rotation of said rotor;

a striking surface on said shaft for receiving force from an operator and transferring at least some of said force through said shaft to cooperative elements of said discharge stopping mechanism;

said discharge stopping mechanism being adapted to react to operative force on said striking surface whereby discharge of fluid from said nozzle is stopped.

4. The invention of claim 3 wherein said discharge stopping mechanism comprises a valve;

said actuator of said discharge stopping mechanism cooperating with said valve whereby operative force on said striking surface induces said valve to prevent the flow of fluid to said nozzle.

5. The invention of claim 3 wherein said discharge actuating mechanism comprises a pump for forcing fluid to said nozzle for discharge therefrom;

said actuator of said discharge stopping mechanism cooperating with said pump whereby operative force on said striking surface disables said pump to prevent the flow of fluid to said nozzle.

6. The invention of claim 1 comprising a valve;

said valve cooperating with said actuator of said discharge stopping mechanism whereby operative manipulation of said actuator causes said valve to prevent the flow of fluid to said nozzle.

7. The invention of claim 1 wherein said discharge actuating mechanism comprises a timing mechanism operable to provide an interval during which discharge from said nozzle is prevented and to subsequently initiate discharge from said nozzle;

said timing mechanism having at least two states of operation;

said timing mechanism, when in a first state, cooperating with other elements of said discharge actuating mechanism to prevent discharge from said nozzle;

said timing mechanism, when in a second state, cooperating with other elements of said discharge mechanism to induce discharge from said nozzle.

8. The invention of claim 1 wherein said discharge actuating mechanism comprises a valve and a cam;

said valve having a first state of operation for preventing fluid from flowing to said nozzle;

said valve having a second state of operation for allowing fluid to flow to said nozzle;

said cam cooperating with other elements of said discharge actuating mechanism whereby operative rotation of said cam induces said valve to switch from said first state of operation to said second state of operation to initiate discharge from said nozzle.

9. The invention of claim 8 including:

said cam having a first range of rotational positioning wherein said cam cooperates with elements of said discharge actuating mechanism to maintain said valve in said first state of operation;

said cam having a second range of rotational positioning wherein said cam cooperates with elements of said discharge actuating mechanism to induce said valve to switch from said first state of operation to said second state of operation;

said discharge actuating mechanism comprising a clock mechanism for imparting rotary motion to said cam;

said clock mechanism being adapted to regulate the speed of rotation of said cam to provide an interval during which said valve is maintained in said first state of operation prior to switching to said second state of operation.

10. The invention of claim 9 wherein said discharge actuating mechanism comprises a spring for storing energy applied by an operator of said toy;

said spring cooperating with said clock mechanism to apply energy to said clock mechanism for operation thereof.

11. The invention of claim 1 wherein said actuator of said discharge stopping mechanism is carried on said rotor.

12. The invention of claim 11 comprising a jet propulsion mechanism for urging said rotor to rotate.

13. The invention of claim 11 including:

said rotor carried for rotation about a generally vertical axis;

said actuator of said discharge stopping mechanism comprising a shaft generally aligned with said axis of rotation of said rotor;

a striking surface on said shaft for receiving force from an operator and transferring at least some of said force through said shaft to cooperative elements of said discharge stopping mechanism;

said discharge stopping mechanism being adapted to react to operative force on said striking surface whereby discharge of fluid from said nozzle is stopped.

14. The invention of claim 13 wherein said discharge stopping mechanism comprises a valve;

said actuator of said discharge stopping mechanism cooperating with said valve whereby operative force on said striking surface induces said valve to prevent the flow of fluid to said nozzle.

15. The invention of claim 13 wherein said discharge actuating mechanism comprises a pump for forcing fluid to said nozzle for discharge therefrom;

said actuator of said discharge stopping mechanism cooperating with said pump whereby operative force on said striking surface disables said pump to prevent the flow of fluid to said nozzle.

16. The invention of claim 11 comprising a valve;

said valve cooperating with said actuator of said discharge stopping mechanism whereby operative manipulation of said actuator causes said valve to prevent the flow of fluid to said nozzle.

17. The invention of claim 11 wherein said discharge actuating mechanism comprises a timing mechanism operable to provide an interval during which discharge from said nozzle is prevented and to subsequently initiate discharge from said nozzle;

said timing mechanism having at least two states of operation;

said timing mechanism, when in a first state, cooperating with other elements of said discharge actuating mechanism to prevent discharge from said nozzle;

said timing mechanism, when in a second state, cooperating with other elements of said discharge mechanism to induce discharge from said nozzle.

18. The invention of claim 11 wherein said discharge actuating mechanism comprises a valve and a cam;

said valve having a first state of operation for preventing fluid from flowing to said nozzle;

said valve having a second state of operation for allowing fluid to flow to said nozzle;

said cam cooperating with other elements of said discharge actuating mechanism whereby operative rotation of said cam induces said valve to switch from said first state of operation to said second state of operation to initiate discharge from said nozzle.

19. The invention of claim 18 including:

said cam having a first range of rotational positioning wherein said cam cooperates with elements of said discharge actuating mechanism to maintain said valve in said first state of operation;

said cam having a second range of rotational positioning wherein said cam cooperates with elements of said discharge actuating mechanism to induce said valve to switch from said first state of operation to said second state of operation;

said discharge actuating mechanism comprising a clock mechanism for imparting rotary motion to said cam;

said clock mechanism being adapted to regulate the speed of rotation of said cam to provide an interval during which said valve is maintained in said first state of operation prior to switching to said second state of operation.

20. The invention of claim 19 wherein said discharge actuating mechanism comprises a spring for storing energy applied by an operator of said toy;

said spring cooperating with said clock mechanism to apply energy to said clock mechanism for operation thereof.

21. The invention of claim 1 wherein said discharge actuating mechanism comprises a valve and a mechanism for selectively opening said valve to allow fluid to flow to said nozzle for discharge therefrom.

22. The invention of claim 1 wherein said discharge actuating mechanism comprises a pump and a mechanism for selectively actuating said pump to force fluid to flow to said nozzle for discharge therefrom.

23. A fluid projecting toy comprising a frame;

a rotor assembly operably carried on said frame;

a propulsion mechanism for driving said rotor through a range of rotary motion;

said propulsion mechanism being at least partially automatic whereby manual turning of said rotor is not required;

said rotor assembly comprising a nozzle for discharge of fluid therefrom;

rotation of said rotor causing the direction of discharge of said nozzle to vary with respect to said frame;

a discharge actuating mechanism for selectively initiating discharge of fluid from said nozzle;

said discharge actuating mechanism being at least partially automatic whereby the initiation of discharge from said nozzle is generally beyond the immediate control of those using said toy;

a discharge stopping mechanism;

said discharge stopping mechanism comprising an actuator adapted to stop discharge from said nozzle upon manipulation of said actuator by an operator of said toy;

said rotor carried for rotation about a generally vertical axis;

said actuator of said discharge stopping mechanism comprising a shaft generally aligned with said axis of rotation of said rotor;

a striking surface on said shaft for receiving force from an operator and transferring at least some of said force through said shaft to cooperative elements of said discharge stopping mechanism;

said discharge stopping mechanism being adapted to react to operative pressure on said striking surface whereby discharge of fluid from said nozzle is stopped;

said discharge actuating mechanism comprising a cam and a clock mechanism for imparting rotary motion to said cam;

said cam having a first range of rotational positioning wherein said cam cooperates with elements of said discharge actuating mechanism to prevent the flow of fluid to said nozzle;

said cam having a second range of rotational positioning wherein said cam cooperates with elements of said discharge actuating mechanism to induce the flow of fluid to said nozzle;

said clock mechanism being adapted to regulate the speed of rotation of said cam through said first range of rotational positioning to thereby provide an interval during which discharge is prevented prior to said cam entering said second range of rotational positioning wherein discharge is allowed.

24. The invention of claim 23 wherein said discharge actuating mechanism comprises a valve;

said valve having a first state of operation for preventing fluid from flowing to said nozzle;

said valve having a second state of operation for allowing fluid to flow to said nozzle;

said cam cooperating with other elements of said discharge actuating mechanism whereby operative rotation of said cam induces said valve to switch from said first state of operation to said second state of operation to initiate discharge from said nozzle.

25. The invention of claim 24 wherein said valve comprises a passageway for conducting fluid and a plunger movable between a first position and a second position;

said plunger in said first position blocking said passageway to prevent the flow of fluid;

said plunger in said second position allowing fluid to flow through said passageway;

said discharge stopping mechanism comprising a linkage between said shaft and said plunger whereby an operative force applied to said striking surface will move said plunger from said second position to said first position.

26. The invention of claim 25 including:

a latch for retaining said plunger in said first position;

said cam engageable with said latch such that operative rotation of said cam releases said plunger from said latch whereby said plunger may move to said second position.

27. The invention of claim 23 wherein said discharge stopping mechanism comprises a valve;

operation of said actuator of said discharge stopping mechanism causing said valve to prevent the flow of liquid to said nozzle.

28. The invention of claim 23 wherein said discharge actuating mechanism comprises a pump;

said cam cooperating with said pump whereby operative rotation of said cam induces said pump to force fluid to flow to said nozzle for discharge therefrom.

29. The invention of claim 28 wherein operation of said actuator of said discharge stopping mechanism serves to prevent said pump from forcing liquid to said nozzle.

30. The invention of claim 28 including:

said pump comprising a plunger movable from a first position to a second position for compression of fluid within a chamber;

a spring for biasing said plunger toward said second position;

a latch for retaining said plunger in said first position;

said cam engageable with said latch such that operative rotation of said cam releases said plunger from said latch whereby said spring may force said plunger to said second position.

31. The invention of claim 30 wherein said discharge stopping mechanism comprises a linkage between said shaft and said plunger whereby an operator of the toy may apply pressure to said actuator to override bias of said spring, to stop motion of said plunger toward said second position and to force said plunger toward said first position.

* * * * *